US008778862B2

(12) United States Patent
Hernandez et al.

(10) Patent No.: US 8,778,862 B2
(45) Date of Patent: Jul. 15, 2014

(54) CONCENTRATED CLEANER IN WATER-DISSOLVABLE POUCH

(75) Inventors: Pablo M. Hernandez, Waukegan, IL (US); Sergio Reyes Salgado, Racine, WI (US); Rahul Saxena, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 59 days.

(21) Appl. No.: 13/477,543

(22) Filed: May 22, 2012

(65) Prior Publication Data

US 2013/0313154 A1 Nov. 28, 2013

(51) Int. Cl.
*C11D 17/00* (2006.01)

(52) U.S. Cl.
USPC ..... 510/296; 510/297; 510/426; 510/432; 510/439

(58) Field of Classification Search
None
See application file for complete search history.

(56) References Cited

U.S. PATENT DOCUMENTS

| | | | |
|---|---|---|---|
| 2,731,338 | A | 1/1956 | Fike et al. |
| 3,282,852 | A | 11/1966 | Trusler |
| 3,528,925 | A | 9/1970 | Chapuis |
| 6,037,319 | A | 3/2000 | Dickler et al. |
| 6,130,196 | A | 10/2000 | Mondin et al. |
| 6,133,214 | A | 10/2000 | Jung et al. |
| 6,136,776 | A | 10/2000 | Dickler et al. |
| 6,326,345 | B1 | 12/2001 | Mondin |
| 6,387,866 | B1 | 5/2002 | Mondin et al. |
| 6,444,632 | B1 | 9/2002 | Mondin |
| 6,451,750 | B2 | 9/2002 | Hewitt et al. |
| 6,479,449 | B1 | 11/2002 | Mondin |
| 6,482,785 | B1 | 11/2002 | Mondin |
| 6,486,109 | B1 | 11/2002 | Mondin |
| 6,511,951 | B1 | 1/2003 | Mondin |
| 6,559,114 | B1 | 5/2003 | Mondin |
| 6,573,227 | B1 | 6/2003 | Mondin |
| 6,586,381 | B1 | 7/2003 | Mondin |
| 6,653,268 | B2 | 11/2003 | Mondin |
| 6,683,037 | B2 | 1/2004 | Mondin |
| 7,125,828 | B2 | 10/2006 | Catlin et al. |
| 7,189,686 | B2 | 3/2007 | Burt et al. |
| 7,417,019 | B2 | 8/2008 | Weber et al. |
| 7,625,856 | B2 | 12/2009 | Burt et al. |
| 2001/0053754 | A1 | 12/2001 | Hewitt et al. |
| 2003/0119696 | A1 | 6/2003 | Ingram et al. |
| 2004/0186035 | A1 | 9/2004 | Johnston et al. |
| 2005/0119150 | A1 | 6/2005 | Pegelow et al. |
| 2005/0245424 | A1 | 11/2005 | Patel et al. |
| 2008/0251105 | A1 | 10/2008 | Toussaint et al. |
| 2011/0146709 | A1 | 6/2011 | Toussaint et al. |
| 2011/0167568 | A1 | 7/2011 | Littig et al. |
| 2011/0167570 | A1 | 7/2011 | Littig et al. |
| 2011/0170938 | A1 | 7/2011 | Littig et al. |
| 2011/0240510 | A1 | 10/2011 | De Poortere |
| 2011/0266169 | A1 | 11/2011 | Catlin et al. |
| 2011/0271979 | A1 | 11/2011 | Mondin et al. |

FOREIGN PATENT DOCUMENTS

| | | | |
|---|---|---|---|
| GB | 1491603 | A | 11/1977 |
| WO | WO02/057402 | A1 | 7/2002 |
| WO | WO02057402 | * | 7/2002 |
| WO | WO03/089563 | A2 | 10/2003 |

OTHER PUBLICATIONS

PCT/US2013/041983 International Search Report and Written Opinion dated Aug. 21, 2013.

* cited by examiner

*Primary Examiner* — Necholus Ogden, Jr.

(57) ABSTRACT

Concentrated liquid cleaning fluid compositions for hard surface cleaning which are particularly suited for storage and dispensing from water-dissolvable plastic pouches. In use the pouches are placed in water whereupon the plastic pouch dissolves allowing the concentrated composition to become diluted in the water to provide a cleaner. The concentrated cleaning composition has good stability and does not affect the plastic or rate of dissolution of the pouch, and allows use of a variety of colorants and fragrances with a base product formulation. The formulation includes a linear alkyl benzene sulfonic acid (LABSA), a nonionic ethoxylated alcohol surfactant, and an alkanol amine or alkyl amine capable of reacting with the LABSA so that the sulfonic group is added to the amine.

25 Claims, No Drawings

CONCENTRATED CLEANER IN WATER-DISSOLVABLE POUCH

FIELD OF INVENTION

Concentrated cleaning compositions for cleaning hard surfaces are described which are particularly suitable for storage and use in water-dissolvable plastic pouches. The concentrated cleaning composition is a liquid and has improved stability so that it has storage longevity, and does not affect the plastic or rate of dissolution of the plastic pouch during storage or in use. The stability of the composition is such that it allows for use of a wide range of both colorants and fragrances providing for greater interchangeability, and thus variance, as to color and fragrance of the product. The stability is achieved while obtaining better cleaning over conventional concentrated cleaners in water-dissolvable plastic pouches.

BACKGROUND OF THE INVENTION

Concentrated cleaning compositions stored in water-dissolvable plastic pouches are in general known. In use the pouches are placed in a container of water where the pouch dissolves allowing the concentrated cleaning composition to become diluted in the water. Upon dilution the composition can be used to clean a hard surface by application with a cloth, sponge, mop, or the like.

Due to the concentration of components in the composition, stability of the composition over extended storage times and rapid dissolution of the pouch and composition can be a problem. For example, high amounts of surfactants and solvents can require the use of a thicker or stronger plastic in formation of the pouch which in turn can reduce the dissolution rate of the pouch. Further, such concentrated amounts can affect the stability of the fragrance and colorant used in the composition. This can either limit the colorants and fragrances available for use in the concentrated composition or require a change in composition formulation upon a change in colorant or fragrance. This increases production costs.

Concentrated cleaners have also been of concern on basis of safety, namely in the concentrated components having toxicity or irritancy with respect to a user. Decreasing concentration of surfactants and solvents, however, conventionally results in a decrease in cleaning efficiency.

Accordingly, concentrated cleaners have numerous properties which are interdependent as to effect based on a change in amount, chemical nature, and the like. The concentrated cleaning compositions of the invention have overcome these problems.

SUMMARY OF THE INVENTION

A concentrated liquid cleaning composition suitable for storage and use in a water-dissolvable plastic pouch is described which has improved stability and cleaning while being safer as to toxicity and irritancy, allowing for good rate of dissolution of the plastic pouch and composition, good viscosity for pourability, and interchangeability as to colorants and fragrances.

The concentrated liquid cleaning composition includes a linear alkyl benzene sulfonic acid anionic surfactant (LABSA), a nonionic linear or branched ethoxylated alcohol, an iso or non-linear alkanol amine or alkyl amine wherein the alkyl group of the alkanol amine or alkyl amine has a carbon chain length of 1-6 carbon atoms, water and/or water-soluble solvent, and, optionally, a non-aqueous solvent, at least one colorant and/or at least one fragrance. The alkanol/alkyl amine and linear alkyl benzene sulfonic acid components react so that the sulfonic group is added to the amine. The composition can have an acidic to slightly alkaline pH, from about 2 to about 8.5. Preferably, the concentrated composition has a neutral to slightly alkaline, such as from about 7 to about 8.5. However, if disinfectant or antimicrobial properties are desired without the addition of a separate disinfectant or antimicrobial compound, the pH preferably is in the acidic range, and if stronger disinfectant or antimicrobial properties are desired, the lower acidic range, i.e., 2-4, should be used. However, if a separate disinfectant or antimicrobial compound (such as o-phenyl phenol or glutaldehyde) is included, the pH can be in the preferred range of about 7 to about 8.5.

The ratio of anionic component to nonionic component is from 0.5:1 to 4:1, preferably 1:1 to 4:1, with 2:1 being most preferred. The ratio of amine component to anionic component is from 1:3 to 1:8, preferably from 1:4 to 1:5 and more preferably 1:3:9.

The ratio between anionic and non-ionic surfactant components and the ratio between amine and anionic surfactant components concern viscosity. The higher the ratios, the composition becomes too viscous to handle. A viscosity to some degree, however, is advantageous based on the manner of use, i.e., the compositions are more controllable from the standpoint of pouring, for example, during filling of the concentrate into plastic pouches during manufacture to provide a cleaning product, and also upon dilution for use with an appropriate applicator for cleaning a hard surface.

The plastic pouch suitable for use with the concentrated cleaning composition is as conventionally known in the cleaning art. For example, polyvinylalcohol in the form of a plastic film can be used to make the pouch. The sides edges can be heat sealed, adhesively adhered, or the like as conventionally known.

Dilution of the concentrated cleaning composition can be at different ratios depending on the ultimate use of the cleaner. For example, a cleaner used as a degreaser preferably will have a lesser dilution, while a cleaner useful as a floor or surface cleaner preferably will have a greater dilution. The dilution ratio of the cleaning composition to water can be in a range of 1:4 to 1:1500.

The invention is more fully described below.

DETAILED DESCRIPTION OF THE INVENTION

A concentrated liquid cleaning composition which is particularly suitable for retention in a water-dissolvable plastic pouch is described. The cleaning composition is retained in a plastic pouch during storage and is diluted prior to use. Such dilution is through placement of the complete pouch in a predetermined amount of water where the pouch dissolves and the cleaning composition is diluted in the water. The diluted composition is then suitable for use as a hard surface cleaner. Hard surfaces suitable for cleaning with the cleaner include metal, plastic, ceramic, wood, composites, and the like. The dilution of the cleaning composition can be in a range of from 1:4 to 1:1500 of cleaning composition to water depending on the particular use to which the diluted cleaner is to be put. For example, a cleaner to be used as a degreaser or heavily soiled surface will have a lesser degree of dilution, such as from 1:5 to 1:50. Whereas a cleaner to be used for touch up or everyday surface cleaning can be more diluted such as from 1:60 to 1:1500.

The concentrated cleaning composition of the invention has increased stability, i.e., for storage in relation to time, non-reaction or non-affect on the plastic of the water-dissolvable pouch, and non-affect on the rate of dissolution of the pouch. The diluted and non-concentrated cleaning composition has increased cleaning ability and yet has less irritancy to a user and, thus, is safer than conventional concentrated cleaners which can have high amounts of surfactant and non-water solvents.

The concentrated cleaning composition of the invention includes a linear alkyl benzene sulfonic acid (LABSA) anionic surfactant, a nonionic ethoxylated alcohol surfactant, an iso or non-linear alkanol/alkyl amine wherein the alkyl group has a carbon chain of 1-6 carbon atoms, water and/or a water-soluble solvent, and optionally a non-aqueous solvent, a colorant, and/or a fragrance. The amine and the LABSA react so that the sulfonic group of the LABSA adds to the amine compound.

More particularly, the concentrated cleaning composition includes about 3 wt. % to about 50 wt. % of a linear alkyl benzene sulfonic acid, about 4 wt. % to about 40 wt. % of a nonionic ethoxylated alcohol surfactant, about 0.8 wt. % to about 15 wt. % of an iso or non-linear C1 to C6 alkanol/alkyl amine compound, about 0.1 wt. % to about 9 wt. % water and/or water-soluble solvent, 0 to about 90 wt. % of a non-aqueous solvent, 0 to about 25 wt. % colorant(s), and 0 to about 25 wt. % fragrance(s). The "wt. %" as referred to in relation to the components of the concentrated liquid cleaning composition is based on the concentrated liquid cleaning composition prior to dilution being 100 wt. %.

The concentrated cleaner requires the inclusion of a linear alkyl benzene sulfonic acid (LABSA) as an anionic surfactant. No other anionic surfactant is required to be present. Certain anionic surfactants can not be present, i.e., sulfates and C9-C18 fatty acids. No advantages are present as to stability in emulsion or solution, or cleaning when a sulfate or C9-C18 fatty acid is present. The reaction of the LABSA with the amine compound of the concentrated cleaner is such that the sulfonic group of the LABSA is added to the amine compound upon reaction. The amine compound and LABSA can be reacted prior to preparation of the cleaning composition to provide an amine salt of the anionic surfactant which is then added together with the other composition components, or alternatively the amine component and the LABSA can be added individually to the composition mixture and reaction will occur at such time. While the anionic surfactant can have a variation in the chain length, such must include a sulfonic group for addition to the amine compound. The alkyl group of the LABSA can have a chain length of 9 to 16 carbon atoms, preferably of 10 to 13. Preferred examples of linear alkyl benzene sulfonic acids suitable for use include dodecyl benzene sulfonic acid, and the linear alkyl benzene sulfonic acids sold under the tradename ADVANCE by Advance India Co. and BIOSOFT-101 as sold by Stepan Co.

The LABSA is present in the concentrated cleaning composition in an amount of about 3 to about 52 wt. %, preferably about 3.5 wt. % to about 49 wt. %, and more preferably about 3.5 wt. % to about 35 wt. %.

The amine component of the concentrated cleaning composition can be an iso or non-linear alkanol/alkyl amine wherein the alkyl group has a carbon chain length of 1-6 carbon atoms. The amine component must be reactable with the LABSA component as set forth above so that the sulfonic group of the LABSA adds to the amine upon reaction with the amine component. Without being bound or limited thereby, it is considered that this reaction serves to provide more stable concentrates with a lower viscosity and better cleaning. Examples of amine components suitable for use in the concentrated cleaning composition include monoisopropanolamine, diisopropanolamine, isopropyl amine, butyl amine, propyl amine, sec-butyl amine, tert-butyl amine, cyclo-hexyl amine, and morpholine. Monoisopropanolamine, diisopropanolamine, isopropyl amine and butyl amine are preferred. Monoisopropanolamine is most preferred. It has been found that linear monoethanolamine (MEA), diethanolamine (DEA) and triethanolamine (TEA) are not suitable for inclusion in the cleaning composition as the amine component or otherwise. None of MEA, DEA or TEA provides stable products or enhances cleaning performance. Additionally, DEA can form undesirable by-products upon reaction with other nitration agents (e.g., sodium nitrite).

The alkanol/alkyl amine component is present in the concentrated cleaning composition in an amount of about 0.5 wt. % to about 12 wt. %, preferably about 0.9 wt. % to about 11 wt. %, and more preferably about 0.86 wt. % to about 10 wt. %.

The nonionic ethoxylated alcohol surfactant preferably has a carbon chain length of C6-C15, preferably of C8-C9 or C12-C13, and ethylene oxide (EO) units of 5-10. The nonionic ethoxylates can be linear or branched, although branched are preferred. Examples of nonionic ethoxylated surfactants suitable for use in the concentrated cleaning composition include alkyl polyethylene glycol ethers, such as sold by BASF Corp. under the tradename LUTENSOL. A preferred LUTENSOL surfactant is LUTENSOL XL 70 (which has 7 EO units and is made with a Guerbet alcohol). Other examples of nonionic surfactants suitable for inclusion are NEODOL 91-6 and NEODOL 91-8 as sold by Shell Chemicals, GENAPOL UD 70 or 80 as sold by Clariant Corp., and TERGITOL 15-S-9 as sold by DOW Chemical. Propylene oxide surfactants do not enhance cleaning as provided by the concentrated cleaning composition. Such only are useful as a low foaming surfactant.

The nonionic ethoxylated alcohol surfactant is present in the concentrated cleaning composition in an amount of about 0.5 wt. % to about 76 wt. %, preferably about 4 wt. % to about 62 wt. %, more preferably about 4 wt. % to about 46 wt. %, and most preferably about 4 wt. % to about 32 wt. %.

The LABSA anionic surfactant is to be present in a ratio to the nonionic ethoxylated alcohol surfactant in a range of 0.5:1 to 4:1, preferably 1:1 to 4:1, and most preferably 2:1. The ratio is based on wt. % of the actives of the ingredients and on the basis that the concentrated cleaning composition equals 100 wt. %. The ratio of LABSA to the ethoxylated alcohol surfactant is relevant to controlling the viscosity of the concentrated cleaning composition. As the ratio gets higher, the composition increases viscosity. If the composition gets too viscous, the composition becomes too hard to handle. The higher viscosity to some degree, however, is desirable based on the manner of use (as opposed to stability) since the cleaning composition can be made more controllable as to pouring.

The non-aqueous solvent, while being optional, is preferably present. Solvents suitable for use can be water-soluble or water-miscible. The non-aqueous solvent is preferably shorter chain (e.g., C4 to C8) alkylene glycols or alkylene glycol ethers, although other solvents are also useful. Examples of alkylene glycols, alkylene glycol ethers, and other solvents suitable for inclusion in the concentrated cleaning composition include hexylene glycol, hexylene glycol ether, benzyl alcohol, phenyl glycol ether, propyl butyl ether and hexyl glycol ether. A water-soluble solvent can be present in place of or together with water. Examples of water-soluble solvents that can be used in place of or together with water are butyl glycol, hexylene glycol, polypropylene glycol, as well as water-soluble glycol ethers such as propylene butyl ether, and C3-C5 alcohols, e.g., isopropanol and propyl alcohol.

The non-aqueous solvent is present in the concentrated cleaning composition in an amount of 0 to about 90 wt. %, preferably about 5 wt. % to about 90 wt. %, more preferably about 5 wt. % to about 40 wt. %, and most preferably about 10 wt. % to about 36 wt. %.

Water is present in the concentrated cleaning composition in a small amount, i.e., about 0.1 wt. % to about 9 wt. %, preferably about 0.5 wt. % to about 3 wt. %, more preferably about 0.75 wt. % to about 2 wt. % and most preferably about 0.75 wt. % to about 1.5 wt. %. The water can be tap water, deionized water, reverse osmosis water and the like. Deionized water is preferred. It is noted that water can be present as an independent component or can be in whole or in part a carrier for another component.

Adjuvants as conventional in cleaning formulations can also be included in the concentrated cleaning composition. Examples of adjuvants suitable for inclusion are colorants, fragrances, biocides, preservatives, chelators (e.g., ethylenediamine tetraacetic acid), sequestrants (e.g., TRILON M, a trisodium salt of methylglycinediacetic acid, as sold by BASF), antioxidants, UV and colorant stabilizers (e.g., TINOGARD TL, linear and branched 2-(2H benzotriazol-2-yl)-6-dodecyl-4-methyl-phenol), biocide (e.g. o-phenyl phenol, glutaldehyde), and hydrotropes (e.g., DOWFAX C10L, an alkyldiphenyloxide disulfonate). As to the fragrance, the fragrance may be provided in the form of a fragrant solvent, such as for example, pine oil.

Due to the stability present in the concentrated cleaning composition, it has been found that the color and fragrance components when present in the composition have increased stability, in particular as compared to cleaning compositions made with MEA. The colorants and fragrances are stable in the compositions of the invention over a wide range which allows for a greater selection of colors and fragrances for inclusion. Additionally, due to the stability of the base composition of the amine, anionic LABSA surfactant, nonionic ethoxylated alcohol surfactant and water or water-soluble solvent, a particular base product can be prepared and different colors and fragrances utilized therewith without the need to reformulate the base product upon changing the colorant or fragrance, and without disturbing the stability, cleaning properties, color sense or fragrance of the composition. The ratio of anionic and nonionic surfactants remain essentially unchanged. This stability provides a great manufacturing asset.

In particular as to fragrance, in view of the stability of the concentrate, the fragrance can be used in a lower amount than conventionally used in concentrated cleaning compositions, but is also readily used in a higher amount without requiring reformulation of the base components of the concentrated composition. The fragrance can be one or more fragrance components present in a total amount of about 0.1 wt. % to about 25 wt. %, preferably about 3.5 wt. % to about 15 wt. %, and more preferably about 3 wt. % to about 15 wt. %. A colorant component, which may be one or more colorants, is present in a range of about 0.01 wt. % to about 0.1 wt. %, preferably about 0.01 wt. % to about 0.05 wt. %. The concentrated cleaning formulation of the invention, in the absence of a colorant, is essentially colorless. Accordingly, a wide range of colorants can be used with the formulation and such colorants only need to be present at low levels.

The pH can range from acidic to slightly alkaline, i.e., about 2 to about 8.5. The base formula can have a pH of acidic to neutral to alkaline without the need for inclusion of a separate pH adjusting component. The desired pH can be provided by adjusting the amount of amine present (i.e., reducing the amount of amine provides an acidic pH), or by adjustment of various combinations of component amounts. Acidic pH is preferred when antimicrobial properties are desired without the addition of a separate antimicrobial compound or soap scum removal is a prime objective of the composition in use. When the pH of the concentrated cleaning composition is in the neutral to slightly alkaline range, preferably the pH is of about 7 to about 8.5, more preferably about 6.9 to about 8.0, and most preferably about 6.8 to about 7.8. When a separate antimicrobial compound is included in the formulation, for example o-phenyl phenol or glutaldehyde, the pH of the composition can be in the preferred range of about 7 to about 8.5. Optimum levels of pH contribute towards obtaining optimum stability and viscosity of the composition.

The water-dissolvable plastic pouch for holding and dispersing upon dissolution in use the concentrated cleaning composition can be as conventionally known and commercially available. Due to the increased stability of the concentrated liquid cleaning composition, such composition does not interact with or affect the plastic of the pouch or the rate of dissolution of the plastic, and, therefore, no special requirements are necessary. The pouch preferably is made of polyvinyl alcohol (PVA). Suitable water-soluble films for making a water-dissolvable pouch are sold by the company MONOSOL. Plastic films suitable for use in preparing a water-dissolvable pouch for a concentrated cleaning composition typically have properties as follows:

1. Tensile strength (125 mil, break, 50% RH)=4,700 to 5,700 psi;
2. Tensile modulus (125 mil, 50% RH)=47,000 to 243,000 psi, preferred range is 140,000 to 150,000 psi;
3. Tear resistance (mean) (ASTM-D-199 gm/ml)=900-1,500;
4. Impact strength (mean) (ASTM-D-1709, gm)=600-1,000;
5. 100% Elongation (mean) (ASTM-D-882, psi)=300-600;
6. Oxygen transmission (1.5 mil, 0% RH, 1 atm)=0.035 to 0.450 cc/100 sq. in./24;
7. Oxygen transmission (1.5 mil, 50% RH, 1 atm)=1.20 to 12.50 cc/100 sq. in./24 h;
8. 100% modulus (mean) (ASTM-D-882, psi)=1,000-3,000; and
9. Solubility (sec) (MSTM-205, 75° F.) disintegration=1-5, dissolution=10-30.

Typical resin properties are:

1. Glass transition temperature (° C.)=28-38, preferred 28-33;
2. Weight average molecular weight (Mw)=15,000 to 95,000, preferred is 55,000 to 65,000; and
3. Number average molecular weight (Mn)=7,500 to 60,000, preferred is 27,000 to 33,000.

Preferred polyvinyl alcohol film is MONOSOL M7030, MONOSOL M8630, MONOSOL M8900, MONOSOL M7061 or MONOSOL C8310. In manufacturing a water-soluble pouch, methods suitable for use include extrusion, blow-molded capsules, and injection molded ampoules or capsules. General examples of these methods are briefly described herein. Other methods are also suitable for use as may be known in the art.

In an extrusion method, extruded film is slit to an appropriate width and wound on cores. Each core holds one reel of film. The reels of slit film are fed to either a vertical form, fill, seal machine (VFFS) or a horizontal form, fill, seal machine (HFFS). The Form, Fill, Seal machine (FFS) makes the appropriate sachet shape (cylinder, square, pillow, oval, etc.) from the film and seals the edges longitudinally (machine direction seal). The FFS machine also makes an end seal (transverse direction seal) and fills the appropriate volume of non-aqueous liquid above the initial transverse seal. The FFS machine then applies another end seal. The liquid is contained in the volume between the two end seals.

Blow molded capsules can be formed from polyvinyl alcohol resin having a molecular weight of about 50,000 to about 70,000 and a glass transition temperature of about 28 to 33° C. Pelletized resin and concentrate(s) are feed into an extruder. The extruder into which they are fed has a circular, oval, square or rectangular die and an appropriate mandrel. The molten polymer mass exits the die and assumes the shape of the die/mandrel combination. Air is blown into the interior volume of the extrudate (parison) while the extrudate contacts a pair of split molds. The molds control the final shape of the package. While in the mold, the package is filled with the appropriate volume of liquid. The mold quenches the plastic. The liquid is contained within the interior volume of the blow molded package.

An injection molded ampoule or capsule can be formed from a polyvinyl alcohol resin having a molecular weight of about 50,000 to about 70,000 and a glass transition temperature of about 28 to 38° C. Pelletized resin and concentrate(s) are fed to the throat of a reciprocating screw, injection molding machine. The rotation of the screw pushes the pelletized mass forward while the increasing diameter of the screw compresses the pellets and forces them to contact the machine's heated barrel. The combination of heat, conducted to the pellets by the barrel and frictional heat, generated by the contact of the pellets with the rotating screw, melts the pellets as they are pushed forward. The molten polymer mass collects in front of the screw as the screw rotates and begins to retract to the rear of the machine. At the appropriate time, the screw moves forward forcing the melt through the nozzle at the tip of the machine and into a mold or hot runner system which feeds several molds. The molds control the shape of the finished package. The package may be filled with liquid either while in the mold or after ejection from the mold. The filling port of the package is heat sealed after filling is completed. This process may be conducted either in-line or off-line.

Generally, the film is formed into a pouch by sealing the edges by heat seal, adhesive, or the like as is conventionally known.

EXAMPLES

Examples of formulations of concentrated cleaning composition in accordance with the invention are set forth below. The test procedure for determining the "% Cleaning Efficiency" or "%. Cleaning" where provided, is described below following the Examples.

Example No. (1)

Example No. (1) illustrates a concentrated cleaning composition useful for general cleaning purposes, according to the invention.

| Ingredients | Wt. % |
|---|---|
| TINOGARD TL (UV & colorant stabilizer) | 0.1-1.0 |
| Fragrance | 5.4-15.0 |
| NINATE N-411 (Stepan Corp.) (Anionic) (Isopropyl amine salt of dodecyl benzene sulfonic acid) | 1.0-40.0 |
| LUTENSOL XL 70 (Nonionic) (100%) (C11 Ethoxylated (7 EO) Alcohol) | 1.0-40.0 |
| Hexylene Glycol | 1.0-90.0 |
| Colorant | 0.001-1.0 |
| Purified water | 0.1-9.0 |

Example Nos. (2)-(4)

Example Nos. (2)-(4) are inventive examples illustrating different ratio levels of the LABSA component to nonionic surfactant.

| | Example No. | | |
|---|---|---|---|
| | (2) | (3) | (4) |
| | Ratio of DDBSA:Nonionic | | |
| Ingredients | 1:2 Wt. % | 2:1 Wt. % | 1:1 Wt. % |
| Dodecyl Benzene Sulfonic Acid (DDBSA) | 25.2 | 50.3 | 32.5 |
| Monoisopropanolamine | 5.5 | 11.1 | 8.3 |
| LUTENSOL XL 70 | 50.3 | 30.6 | 46.2 |
| Lavender Fragrance | 5.5 | 5.5 | 5.5 |
| Water | 2.5 | 2.5 | 2.5 |
| Dilution | 1.5% | 1.5% | 1.5% |
| % Cleaning Efficiency | 10.8 | 12.4 | 9.9 |

Example Nos. (5)-(12)

Examples (5)-(12) are inventive examples of floor cleaners.

| | Example No. | | | |
|---|---|---|---|---|
| Ingredients | (5) Wt. % | (6) Wt. % | (7) Wt. % | (8) Wt. % |
| Dodecyl Benzene Sulfonic Acid (98%) (Anionic) | 3.5 | 3.5 | 3.5 | 3.5 |
| LUTENSOL XL 70 (100%)(Nonionic) ($C_{11}$ Ethoxylated (7 EO) alcohol) | 4.5 | 4.5 | 4.5 | 4.5 |
| Monoisopropanolamine | 0.86 | 0.86 | 0.86 | 0.86 |
| Fragrance - (Different for each formula except for 3 & 7, and 5 & 6, and 8 & 6) | 5.4 | 5.4 | 5.4 | 3.0 |
| Deionized Water | 0.75 | 0.75 | 0.75 | 0.75 |
| Hexylene Glycol | 84.987 | 84.986 | 84.988 | 87.376 |
| Colorant (1) & (2) (All different) | 0.003 | 0.004 | 0.002 | 0.007(1) 0.007(2) |
| TOTAL | 100 | 100 | 100 | 100 |
| pH (1% tap water) | 7.46 | 7.33 | 7.33 | 7.43 |
| Viscosity @ 77° F. (cps) (#2 spindle @ 12 rpms) | 102.5 | 77.5 | 90 | 80 |

-continued

| Ingredients | Example No. (9) Wt. % | (10) Wt. % | (11) Wt. % | (12) Wt. % |
|---|---|---|---|---|
| Dodecyl Benzene Sulfonic Acid (98%) (Anionic) | 3.5 | 3.5 | 3.5 | 3.5 |
| LUTENSOL XL 70 (100%)(Nonionic) ($C_{11}$ Ethoxylated (7 EO) alcohol) | 4.5 | 4.5 | 4.5 | 4.5 |
| Monoisopropanolamine | 0.86 | 0.86 | — | — |
| Triethanolamine | — | — | 1.56 | 1.56 |
| Fragrance - (Different for each formula except for 3 & 7, and 5 & 6, and 8 & 6) | 5.4 | 3.0 | 5.4 | 5.4 |
| Deionized Water | 0.75 | 0.75 | 0.75 | 0.75 |
| Hexylene Glycol | 84.985 | 87.387 | 84.2885 | 85.035 |
| Colorant (1) & (2) (All different) | 0.005 | 0.003 | 0.0015 | 0.005 |
| TOTAL | 100 | 100 | 100 | 100 |
| pH (1% tap water) | 7.33 | 7.32 | 6.80 | 6.59 |
| Viscosity @ 77° F. (cps) (#2 spindle @ 12 rpms) | 90 | 95 | 112.5 | 102.5 |

Example No. (13)

Example No. (13) is an inventive example of a heavy duty degreaser diluted for spray bottle application.

| Ingredients | Wt. % |
|---|---|
| Dodecyl Benzene Sulfonic Acid | 34.0 |
| Monoisopropanolamine | 8.0 |
| LUTENSOL XL 70 | 22 |
| Benzyl Alcohol | 18 |
| Hexylene Glycol Ether | 18 |
| Dilution | 1.0% |
| % Cleaning Efficiency | 9.0 |

Example Nos. (14)-(18)

Example Nos. (14)-(18) illustrate concentrated cleaning compositions of the invention having the same base formulas but different fragrances. Example Nos. (14) and (15) have a first common fragrance, but in different amounts. Example Nos. (16)-(18) have a second common fragrance, but in different amounts. All compositions were determined to be stable both for color and stability as well as be suitable for use with various MONOSOL films, i.e., PVA films.

| Ingredients | Example No. (14) Wt. % | (15) Wt. % |
|---|---|---|
| LABSA (98%) | 3.5 | 3.5 |
| LUTENSOL XL 70 | 4.5 | 4.5 |
| Monoisopropanolamine | 0.78 | 0.86 |
| Deionized Water | 0.75 | 0.75 |
| Floral Green Fragrance | 5.4 | 10.0 |
| Hexylene Glycol | 85.066 | 80.386 |
| Colorant | 0.004 | 0.004 |
| Total | 100.00 | 100.00 |
| Appearance/color/stability | TMS* | TMS* |
| pH (10%) in tap water | 6.5-7.5 | 6.5-7.5 |
| Viscosity @ 77° F. #2 Spindle 12 rpm | 80-110 | 80-110 |

-continued

| Ingredients | Example No. (16) Wt. % | (17) Wt. % | (18) Wt. % |
|---|---|---|---|
| LABSA (98%) | 3.5 | 3.5 | 3.5 |
| LUTENSOL XL 70 | 4.5 | 4.5 | 4.5 |
| Monoisopropanolamine | 0.78 | 0.86 | 0.86 |
| Deionized Water | 0.75 | 0.75 | 0.75 |
| Citrus Floral Fragrance | 5.4 | 8.0 | 10.0 |
| Hexylene Glycol | 85.066 | 82.385 | 80.385 |
| Colorant | 0.005 | 0.005 | 0.005 |
| Total | 100.00 | 100.00 | 100.00 |
| Appearance/color/stability | TMS* | TMS* | TMS* |
| pH (10%) in tap water | 6.5-7.5 | 6.5-7.5 | 6.5-7.5 |
| Viscosity @ 77° F. #2 Spindle 12 rpm | 80-110 | 80-110 | 80-110 |

*TMS = To Meet Standard

Comparative Examples

U.S. Pat. No. 6,037,319 describes water-soluble packets containing liquid cleaning concentrates. The use of sodium lauryl sulfate (SLS) as a key surfactant in various concentrate formulations is disclosed. Example 1 (column 5, line 5) in U.S. Pat. No. 6,037,319 of a neutral floor cleaner containing sulfur-containing anionic surfactant, an amine and a nonionic surfactant is set forth for comparison purposes below as Example No. (19). Example Nos. (20)-(23) are examples of compositions according to the invention wherein different amine components are utilized. Examples (24)-(27) are examples of compositions of the invention wherein different nonionic surfactants are used, i.e., the nonionic surfactants are within a C6-C15 chain length and 3-12 EO units. The compositions of Example Nos. (19)-(27) were tested under identical conditions to determine the "% Cleaning Efficiency" according to the test procedure set out below following the examples. Inventive Example Nos. (20)-(27) were shown to provide better cleaning than comparative Example No. (19).

Examples Nos. (19)-(23)

| Ingredient | Example No. (19) (Comparative) Wt. % | (20) Wt. % | (21) Wt. % | (22) Wt. % | (23) Wt. % |
|---|---|---|---|---|---|
| Dimethyl Monoethyl ether | 75.49 | | | | |
| Hexylene Glycol | | 75.79 | 74.44 | 76.09 | 75.79 |
| Sodium lauryl sulfate | 8.00 | | | | |
| Dodecyl Benzene Sulfonic Acid (98%) | | 7.0 | 7.0 | 7.0 | 7.0 |
| Dimethyl glyoxime | 0.50 | | | | |
| Monoethanolamine (MEA) | 0.4 | | | | |
| Monoiso-propanolamine | | 1.6 | | | |
| Diisopropanolamine | | | 2.95 | | |
| Isopropyl amine | | | | 1.3 | |
| Butyl amine | | | | | 1.6 |
| LUTENSOL XL 70 | | 13.61 | 13.61 | 13.61 | 13.61 |
| Nonyl phenol (9.5 mole EO) | 13.61 | | | | |
| Water | 2.0 | 2.0 | 2.0 | 2.0 | 2.0 |
| % Cleaning Efficiency @ 2.5% dilution | 0.1 | 3.0 | 3.7 | 4.9 | 4.2 |

Examples Nos. (24)-(27)

| Ingredients | Example No. (24) Wt. % | (25) Wt. % | (26) Wt. % | (27) Wt. % |
|---|---|---|---|---|
| Dodecyl benzene sulfonic Acid (98%) | 7.0 | 7.0 | 7.0 | 7.0 |
| Monoisopropanolamine | 1.6 | 1.6 | 1.6 | 1.6 |
| Nonyl Phenol (9.5 EO) | | 13.6 | | |
| NEODOL 91-6 (C9-C11 6 EO)* | | | | 13.6 |
| GENAPOL UD 070 (C11 7 EO)** | | | 13.6 | |
| LUTENSOL XL 70 (C10 7 EO) | 13.6 | | | |
| Water | 2.0 | 2.0 | 2.0 | 2.0 |
| Hexylene Glycol | 76.09 | 76.09 | 76.09 | 76.09 |
| % Cleaning Efficiency @ 2.5% Dilution | 3.0 | 4.8 | 3.3 | 4.3 |

*NEODOL 91-6 = C9-11 primary alcohol ethoxylate with avg. 6 moles EO/mole of alcohol.
**GENAPOL UD 070 = Ethoxylated Undecyl alcohol (100%).

Accordingly, a combination of nonionic surfactant, amine compound and LABSA are shown to have better cleaning than a composition containing a sulfate surfactant, MEA and an ethoxy-containing nonionic surfactant.

Example Nos. (28)-(31)

Example No. (28) is a commercially available non-concentrate multi-use cleaner dispensed by spray bottle sold in the United States under the tradename FABULOSO by Colgate. The ingredients and amounts for Example No. (28) were obtained from the product's MSDS (Material Safety Data Sheet). Example Nos. (29)-(31) are compositions of the invention having identical components but diluted at different levels as noted. The "% Cleaning Efficiency" shows that a concentrate can be made which, when diluted at different levels (including at a very dilute level as used for spray bottle applications), approximately the same or better cleaning performance can be obtained.

| Ingredients | Example No. (28) Comparative Wt. % | (29) Wt. % | (30) Wt. % | (31) Wt. % |
|---|---|---|---|---|
| Sodium Dodecyl Benzene Sulfonate (Linear) | 1-5 (MSDS) | | | |
| Dodecyl Benzene Sulfonic Acid (Linear) | | 50.3 | 50.3 | 50.3 |
| C9-C11 Pareth 8* | 1-5 (MSDS) | | | |
| LUTENSOL XL 70 | | 30.6 | 30.6 | 30.6 |
| Monoisopropanolamine | | 11.1 | 11.1 | 11.1 |
| Lavender Fragrance | 1-5 (MSDS) | 5.5 | 5.5 | 5.5 |
| Water | Balance | 2.5 | 2.5 | 2.5 |
| Dilution | Neat | 1% | 1.5% | 2.0% |
| % Cleaning Efficiency | 14.2 | 10.9 | 12.4 | 15.9 |

*Polyethylene glycol ether of a mixture of synthetic $C_{9-11}$ fatty alcohol with an avg. of 8 moles of ethylene oxide.

Example Nos. (32)-(44)

Example Nos. (32)-(44) are further comparative formulations to show the effect as to cleaning efficiency, physical composition stability (stability) and color stability. Since the test method for determining "% Cleaning" (aka "% Cleaning Efficiency") is a stringent test, each of Example Nos. (32)-(44) were run at 2.5% dilution in tap water and run on a Gardner Straight line Abrasion Tester (per method) using 15 cycles with 15 mls of diluted product on a sponge. Readings were measured using a Minolta Colorimeter before and after cleaning. "% Cleaning" is calculated based on comparison to a clean white tile with no soil. Three replicates were run per product.

Example Nos. (32)-(44) Formulations

| Example No. | Alkali/Amine Wt. % | Anionic Wt. % | Surfactant Wt. % | Solvent Wt. % | Fragrance Wt. % |
|---|---|---|---|---|---|
| (32) Comparative | — | SLES 8.0 | Ethoxylated Fatty Alcohol 70 | IPA/PG 9 | 10 |
| (33) Comparative | MEA 1.0 | SLES 8.0 | Nonyl Phenol (9.5 EO) 13.6 | Dimethyl Ethyl Ether 75.5 | — |
| (34) Comparative | NaOH 2.5 | DDBSA 10 | LUTENSOL XL-70 72.48 | — | 15 |
| (35) | NaOH/MEA | DDBSA | LUTENSOL XL-70 | — | 15 |

-continued

| Example No. | Alkali/Amine Wt. % | Anionic Wt. % | Surfactant Wt. % | Solvent Wt. % | Fragrance Wt. % |
|---|---|---|---|---|---|
| Comparative (36) | 0.65/1.75 MEA | 10 DDBSA | 71.07 LUTENSOL XL-70 | — | 15 |
| Comparative (37) | 2.1 Isopropyl | 10 DDBSA | 71.4 LUTENSOL XL-70 | — | 15 |
| Comparative (38) | Amine 2.3 Isopropyl | 10 DDBSA | 73.5 LUTENSOL XL-70 | — | 15 |
| Invention (39) | Amine 2.3 MEA | 10 DDBSA | 73.5 Emulsogen A | — | 15 |
| Comparative (40) | 2.1 Isopropyl | 10 DDBSA | 71.07 Emulsogen A | — | 15 |
| Comparative (41) | Amine 2.2 DEA | 7.8 DDBSA | 61.07 LUTENSOL XL-70 | Hexylene | 5.4 |
| Comparative (42) | 1.8 TEA | 4.0 DDBSA | 4.5 LUTENSOL XL-70 | Glycol 82.95 Hexylene | 5.4 |
| Comparative (43) | 2.2 — | 4.0 SLES | 4.5 LUTENSOL XL-70 | Glycol 83.75 Hexylene | 5.4 |
| Comparative (44) | | 5.0 | 4.5 | Glycol 84.6 | |
| Invention | Isopropanol Amine 1.1 | DDBSA 4.0 | LUTENSOL XL-70 4.5 | Hexylene Glycol 83.75 | 5.4 |

Example Nos. (32)-(44) Formulation Properties

| Example No. | % Cleaning (avg.) | Viscosity (cps) | Stability | Color Stability | pH |
|---|---|---|---|---|---|
| (32) | −3.2 | 150 | Clear | Stable | 6.92 |
| Comparative (33) | 1.6 | — | Clear | Stable | 7.6 |
| Comparative (34) | N/A | >1000 | Separates | — | — |
| Comparative (35) | 9.9 | 907.5 | Hazy | Fades | 7.75 |
| Comparative (36) | 11.9 | 192.5 | Hazy | Fades | 7.88 |
| Comparative (37) | 11.6 | 140 | Slight Precipitation | Fades | 7.53 |
| Comparative (38) | 14.2 | 152.5 | Clear | Stable | 7.14 |
| Invention (39) | −6.7 | 142.5 | Clear Dilution Unstable | Fades | 7.98 |
| Comparative (40) | −5.7 | 135 | Clear Dilution Unstable | Fades | 7.50 |
| Comparative (41) | −4.0 | N/A | Clear | Stable | 7.98 |
| Comparative (42) | −4.9 | N/A | Clear | Stable | 6.92 |
| Comparative (43) | −3.6 | N/A | Clear | Stable | 7.67 |
| Comparative (44) | 3.0 | 87.50 | Clear | Stable | 7.50 |
| Comparative | | | | | |

SLES=Sodium lauryl ether sulfate

IPA/PG=Isopropyl alcohol/propylene glycol

MEA=Monoethanolamine

NaOH=Sodium hydroxide

DDBSA=Dodecyl benzene sulfonic acid

LUTENSOL XL-70=Ethoxylated alcohol ($C_{11}$/7 EO units)

Emulsogen A=Nonionic fatty acid oxethylates=Fatty acid Polyglycol ether (5.5 EO) based on oleic acid DEA=Diethanolamine TEA=Triethanolamine The results show that use of an amine or anionic or non-ionic surfactant outside the combination of the invention results in a poorer cleaning performance. Viscosity is important as to both manufacturing and more rapid dissolution of the concentrate in a PVA pouch. A lower viscosity is most beneficial and the amines are shown here to affect viscosity level.

Examples Nos. (45)-(48)

Example Nos. (45)-(48) are of bathroom hard surface/toilet bowl cleaners. Example Nos. (45)-(47) are concentrated formulations of the invention which have been diluted with tap water to provide for compositions dispensable as spray bottle applications, so as to be comparable to Example No. (48) which is a bathroom cleaner sold by Clorox under the tradename "Tilex". The inventive Example Nos. (45)-(47) are non-caustic compositions, whereas Example No. (48) is a caustic composition, and yet the compositions of Examples (45)-(47) (which are at neutral pH and acidic pH as indicated) are comparable to Example No. (48) with respect to removal of soap scum and sanitizing effect.

| | Example No. | | | |
|---|---|---|---|---|
| Ingredients | (45) Wt. % | (46) Wt. % | (47) Wt. % | (48) Tilex Bathroom Cleaner (Clorox) (Lemon Scent) Wt. % |
| LABSA (98%) | 49.0 | 49.0 | 49.0 | |
| LUTENSOL XL 70 | 30.6 | 36.6 | 32.1 | |
| Monoisopropanolamine | 12.0 | 6.0 | 10.5 | |
| Deionized Water | 2.9 | 2.9 | 2.9 | |
| Fragrance - Lavender | 5.5 | 5.5 | 5.5 | |
| n-alkyl($C_{12}$-$C_{18}$)dimethyl benzyl ammonium chloride | | | | 0.1375 (MSDS) |
| n-alkyl ($C_{12}$-$C_{14}$)dimethyl ethylbenzyl ammonium chloride | | | | 0.1375 (MSDS) |
| Tetrapotassium ethylenediamine tetraacetate (EDTA) | | | | 1-5 (MSDS) |
| Diethylene glycol monobutyl ether | | | | 3-7 (MSDS) |
| pH (6.2% in Tap Water) | 7.78 | 2.08 | 2.58 | 11.5-12.5 (MSDS) |
| % Soap Scum Removal (Weight Average) at 6.2% Dilution - Average of three tiles | 16.3 | 26.8 | 18.2 | 24.6 (As is from Spray Bottle) |
| Sanitizing Activity (5 | | | | |

-continued

| Ingredients | Example No. (45) Wt. % | (46) Wt. % | (47) Wt. % | (48) Tilex Bathroom Cleaner (Clorox) (Lemon Scent) Wt. % |
|---|---|---|---|---|
| minute contact time) @ 6.2% Dilution in Tap Water Modified AOAC Germicidal Spray Method 961.2 (U.S. EPA Efficacy Data Requirements for Sanitizer Test DIS/TSS-10 Jan. 7, 1982) | | | | |
| Gram-negative organism (*P. aeruginosa*) | Pass | Pass | Pass | Pass (EPA Label) |
| Gram-positive organism (*S. aureus*) | Failed | Pass | Pass | Pass (EPA Label) |
| % Cleaning Effiency at 6.2% Dilution | | 14.7 | | 12.7 (Neat) |

Example Nos. (49)-(59)

Example Nos. (49) to (59) are floor cleaner concentrate formulations containing different fragrances so as to show their stability. Example Nos. (49) and (50) are comparative examples. As noted, Example Nos. (49) and (50) each failed as to both product stability and color stability.

| Ingredients | Example No. (49) Wt. % | (50) Wt. % | (51) Wt. % | (52) Wt. % | (53) Wt. % | (54) Wt. % | (55) Wt. % | (56) Wt. % | (57) Wt. % | (58) Wt. % | (59) Wt. % |
|---|---|---|---|---|---|---|---|---|---|---|---|
| LABSA (98%) | 5.0 | 2.59 | 3.5 | 3.5 | 3.5 | 3.5 | 3.5 | 3.5 | 3.5 | 3.5 | 3.5 |
| LUTENSOL XL 70 | | | 4.5 | 4.5 | 4.5 | 4.5 | 4.5 | 4.5 | 4.5 | 4.5 | 4.5 |
| GENAPOL UD 70 | 4.5 | 4.41 | | | | | | | | | |
| NaOH | | 0.04 | | | | | | | | | |
| Monoethanolamine | 1.0 | 0.17 | | | | | | | | | |
| Isopropanolamine | | | 0.78 | 0.86 | 0.78 | 0.86 | | 0.86 | 0.78 | 0.86 | 0.78 |
| Triethanolamine | | | | | | | 1.56 | | | | |
| Fragrance | | | | | | | | | | | |
| Citrus Mint | | | | | | | | | | | 5.4 |
| Eucalyptol | | | | | 3.0 | 5.4 | | | | | |
| Floral Green | 5.4 | | 5.4 | 10.0 | | | | | | | |
| Pine Woody | | 3.1 | | | | | | | 5.4 | 10.0 | |
| Citrus Floral | | | | | | | 5.4 | 10.0 | | | |
| Deionized Water | 0.75 | 0.75 | 0.75 | 0.75 | 0.75 | 0.75 | 0.75 | 0.75 | 0.75 | 0.75 | 0.75 |
| Colorant | 0.005 | 0.005 | 0.004 | 0.004 | 0.08 | 0.08 | 0.0015 | 0.0015 | 0.005 | 0.005 | 0.003 |
| Hexylene Glycol | 82.85 | 88.935 | 85.066 | 80.386 | 87.39 | 84.91 | 84.2885 | 80.3885 | 85.065 | 80.39 | 85.067 |
| Product Stability @ 45° C. (1 Month) | Fail | Fail | Pass | Pass | Pass | Pass | Pass | Pass | Pass | Pass | Pass |
| Color Stability @ 45° C. (1 Month) | Fail | Fail | Pass | Pass | Pass | Pass | Pass | Pass | Pass | Pass | Pass |
| Stability (3 Month) with Monosol PVA Films | | | | | | | | | | | |
| M8630 | | | Pass | Pass | Pass | Pass | Pass | Pass | Pass | Pass | Pass |
| M7061 | | | Pass | Pass | Pass | Pass | Pass | Pass | Pass | Pass | Pass |
| M8900 | | | Pass | Pass | Pass | Pass | Pass | Pass | Pass | Pass | Pass |
| C8400 | | | Pass | Pass | Pass | Pass | Pass | Pass | Pass | Pass | Pass |
| C8310 | | | Pass | Pass | Pass | Pass | Pass | Pass | Pass | Pass | Pass |

The test for determining "% Cleaning Efficiency" or "% Cleaning" in Examples (2)-(4), (13) and (19)-(31), as well as the cleaning efficiency testing for Example Nos. (45)-(48), herein is based on ASTM D 4488-95 Section A6 and is set forth below. The purpose of the test is to determine the cleaning efficacy of hard surface cleaning products relative to removal of greasy soil. The test consists of the application of a greasy soil mixture to porcelain enameled metal tile using silk screening, baking the tile, and scrubbing the tile using a cellulose sponge and a linear scrubbing machine. Cleaning efficacy is determined by color. The test is a direct comparison test used to evaluate the efficacy of hard surface cleaners relative to each other and/or to a cleaner chosen as a "standard". The techniques used to apply soil to the substrate and used in determining the test endpoint will effect the reproducibility of the results. An operator must be fully trained to insure generation of reliable data and one individual should be employed throughout and entire study.

The apparatus and reagents used in the test were follows:

A. White porcelain enameled tiles, 4.5 in.×5 in. (Boesch, Inc., Belleville, Ill. 62220).

B. Silk screen, of mesh size and template dimensions specified for the conditions of the test to be run, and with screen and frame dimensions of approximate size for convenient application use. The recommended screen size is approximately 10 in.×12 in. (excluding frame). The template size should be 2.5 in.×4.0 in. unless another dimension is specified for the test.

C. Silk screening applicator and holder for the silk screen and tile.

D. Concentrated cleaning solution, Alconox® or Micro® brand no-residue laboratory cleaner (or equivalent).

E. Wet abrasion scrub tester, Sheen model 903 or equivalent.

F. Cellulose sponges, finepore 3 in.×1.75 in.×0.625 in.

G. Conveyor oven capable of maintaining temperatures of 45° C. and 180° C. and transporting tiles through the heating zone for time period of 11 min. (Nu-Vu® Pizza Oven, model ECP-1 or oven with equivalent features).

H. Finely powdered sugar.

I. Hydrogenated beef tallow.

J. Vegetable oil, more than 50% unsaturated.

K. Powdered egg albumen.

L. Dodecane, reagent grade, CAS #57-55-6-60.

M. Carbon Black powder.

The procedure of the test is as follows:

A. Preparation of Greasy Soils

1. Preparation of 8/9/9/24 Albumen/Tallow/Vegetable Oil/Sugar Soil:

Weigh 36 grams hydrogenated beef tallow, 36 grams vegetable oil, and 100 grams Dodecane into 600 ml beaker. Heat on a steam bath (preferred) or hotplate until mixture has melted. Then add 96 grams of finely powdered sugar and stir until a uniform mixture is obtained. Add 1 gram of carbon black powder, and 32 grams of powdered egg albumen to the hot liquid. Mix thoroughly by manual stirring. Allow to cool to room temperature. Stir during cooling to prevent settling.

B. Preparation of Tiles

1. Scrub the white porcelain enameled metal tiles with warm tap water and Micro cleaner.
2. Rinse with deionized water.
3. Place tiles in a rack and dry at ambient temperature for 1 hour.
4. Wipe tiles with acetone and cheesecloth.
5. Rack tiles, 6 to a rack, maximizing space separating each tile.
6. Bake racked tiles in a convection oven at 180° C. for 5 minutes.
7. Alternatively, bake tiles individually in a conveyor oven at 180° C. for 5 minutes.
8. Allow tiles to cool in humidity chamber for at least 48 hours before use.

C. Application of Greasy Soil to Tiles

Tiles used for application of greasy soil must have been cleaned and heated according to step B of this procedure. Tiles must have been acetone wiped and heated. Weigh a tile, to 4 decimal places, on an analytical balance and record the weight. Place the tile in the silk screen tile holder, place a 125 mesh silk screen over the tile and apply a coating of greasy soil suspension with the applicator. Weigh the tile to determine if the amount of wet coating is within the range to yield a final coating weight range specified for the conditions of the test. For normal testing the weight should be between 0.31 g and 0.39 g. If the wet coating weight is outside these specifications, re-apply the coating.

Heat the soiled tiles in a conveyor oven at 180° C. for 10 min. Store in an open rack (preferably in a constant temperature environmental temperature chamber) at room temperature (approximately 22° C.) overnight.

D. Cleaning Efficacy Testing

1. Set up. Switch the scrubbing machine to "on". Set the scrubbing machine to a predetermined number of cycles, if applicable. A cycle is defined as a pass of the sponge across the tile in two directions (one direction and back in the opposite direction) with the sponge returning to its original position.

2. Sponge Preparation. Take dry cellulose sponge and condition it by wetting and wringing it 10-15 times first in warm tap water followed by 10-15 in deionized water. The sponges should then be allowed to sit over night, or until completely dry; however, if time does not allow you to let them air dry, you may send them through the conveyor oven at 180° C. for two cycles of four minutes followed by three minutes in length.

3. Initial Tile Reading. With a Minolta Chroma Meter CR-400/410 take nine color readings on half of the soiled part of the tile beginning at the utmost top right corner and moving a total of three down before moving left one space and moving down to take the next three readings. You should have a predetermined left and right side to the tile as this will help avoid confusion when taking the readings and then cleaning. The initial reading should correspond with the same tile, same side for the after reading. All tiles may have a hole punched out in one corner, that hole can then be used to orientate what side of the tile you are looking at, for example, the tile may be positioned so that the hole is always in the upper left corner. After the first half is read, the second half must then be read in the same manner. The first half will be cleaned with your control while the second half will be cleaned with whatever formula/product you are evaluating, this will enable you to make a direct comparison.

4. Scrub Testing Procedure. Place a soiled tile in the sample holder of the scrubbing machine, soiled side up. As each tile has two sides, it will then be scrubbed twice, once on each side. Start by placing the tile so that the control side will be scrubbed first. Pipette 15 mL of the product into a weigh boat so that you may next take a prepped sponge, that is completely dry, and place it into the weigh boat so that the solution may then be absorbed by the sponge. Place the now saturated sponge into the designated sponge holder. Five random tiles are selected to determine the number of strokes needed to reach 75% removal with the control. Once the number of strokes has been determined then if the scrubbing machine has a pre-set cycle feature set it and then press the start button. If the scrubbing machine has a manual cycle feature, press and hold down the "cycle" button or switch until the prescribed number of cycles has been completed. After scrubbing, remove the tile gently patting away any excess solution that may remain on the tile but being very careful as to not remove and soil. Next wipe any excess solution that may remain on the machine before placing the tile back in the sample holder so that the test variable side may now be scrubbed, repeating the same procedure as used on the control side. If the control is not between 65-85% then that tile is discarded from the test.

5. After Scrubbing Reading. Repeat the Initial Tile Reading procedure. Nine readings per half, for a total of eighteen readings per tile.

The test used for determining soap scum removal for the bathroom cleaners of Example Nos. (45)-(48) is as follows:

The purpose of the test is to determine the cleaning efficacy of hard surface cleaning products relative to removal of soap scum. The test consists of the application of a calcium oleate/stearate mixture to porcelain enameled metal tile using silk screening, baking the tile, spraying the tile with the product from the intended delivery system, i.e., trigger sprayer, and then rinsing with deionized water. Cleaning efficacy is determined gravimetrically. The test is a direct comparison test and is used to evaluate the efficacy of hard surface cleaners relative to each other and/or to a cleaner chosen as a "standard".

The apparatus and reagents used in the soap scum test were as follows:

A. White porcelain enameled tiles, 4.5 in.×5 in.

B. Silk screen, of mesh size and template dimensions specified for the conditions of the test to be run, and with screen and frame dimensions of appropriate size for convenient application use. The recommended screen size is approximately 10 in.×12 in. (excluding frame). The template size should be 2.5 in.×4.0 in. unless another dimension is specified for the test.

C. Silk screening applicator and holder for the silk screen frame and tile.

D. Concentrated cleaning solution, Alconox® or Micro® Brand no residue laboratory cleaner or equivalent.

E. Conveyor oven capable of maintaining temperatures of 80° C. and 180° C. and transporting tiles through the heating zone for a time periods of 2, 5, and 10 minutes (Nu-Vu® Pizza Oven, model ECP-1 or oven with equivalent features).
F. Homogenizer, Tekmar Tissuemizer 89-066-09, Fisher Scientific PowerGen 700 GLH-115 or equivalent.
G. Sodium stearate, technical grade, CAS #622-16-2.
H. Sodium oleate, technical grade, CAS #143-19-1.
I. Calcium chloride, technical grade, CAS #10043-52-4.
J. Propylene glycol, reagent grade.
K. Sudan IV dye, CAS #85-83-6.
L. Vacuum oven.
M. Teflon coated baking dish.
N. 2 Buchner funnels (large and small).
O. #2 qualitative filter paper.

The procedure in conducting the test was as follows:

A. Preparation of Soap Scum Soil (1:1 calcium stearate/oleate).
1. In a clean 2 liter beaker, heat 1400 mL of deionized water to 75° C.±5° C.
2. Add 20 grams sodium oleate and 20 grams sodium stearate. Stir, with a mechanical stirrer, until dissolved. Maintain the stirred solution at 75° C.±5° C.
3. In a 4 liter beaker, heat an additional 1400 mL deionized water to 75° C.±5° C.
4. Add 30 grams calcium chloride, and stir until dissolved.
5. Homogenize the calcium chloride solution. (Tissuemizer setting of 30 or PowerGen 700 setting of 2).
6. Gradually add the heated soap solution (over a period of approximately 2-3 minutes). A precipitate of fatty acid calcium salts will form immediately.
7. Continue homogenizing the mixture for 30 Minutes. (PowerGen 700 setting of 2).
8. Vacuum filter the precipitate using large Buchner funnel and #2 qualitative filter paper.
9. Wash the precipitate with at least 600 mL of hot (approximately 75°) deionized water.
10. Transfer the washed precipitate to Teflon coated baking dish and dry in a 48° C.±2° C. vacuum oven for at least 48 hours. (Breaking up large chunks helps in drying).
11. Cool the dried calcium soap to room temperature and pulverize with a mortar and pestle.
12. Store the powdered calcium soap in a desiccator. The approximate yield is 36 grams.

B. Preparation of Soap Scum Soil Suspension.
1. Preparation of 13% Nonvolatile Soap Scum Suspension:
a. Prepare a solution of 0.038% wt./wt solution of Sudan IV dye in propylene glycol as follows:
i. Add 0.19 g. of Sudan IV to 500 g. propylene glycol,
ii. homogenize for 5 minutes. (Tissuemizer setting of 30 or PowerGen 700 setting of 2),
iii. Filter using Whatman 41 filter paper (or equivalent).
b. Add, with hand stirring using a spatula,
i. 30 g of powdered 1:1 calcium stearate/oleate,
ii. to 200 g of filtered 0.038% Sudan IV dye solution in propylene glycol.
iii. Continue hand stirring until the powder is blended into the Sudan solution,
iv. Homogenize the solution for 20 minutes. (Tissuemizer setting of 30 or PowerGen 700 setting of 2).
v. At this point the mixture should become a thick paste which no longer flows with further mixing with the homogenizer,
vi. If the mixture does not thicken to this degree, homogenize up to an additional 15 minutes. If the mixture still does not thicken properly, the preparation should be repeated.

(It is noted that 13% is the nominal (theoretical) value of this soap scum suspension. The actual nonvolatile values obtained under the conditions of the tile preparation (at 180° C. for 2 min. as described in part D below of this procedure) have been found be slightly lower.)

2. Preparation of Soap Suspensions with Lower Nonvolatiles: If a soap suspension with a lower nonvolatile is needed for the test, the amount of calcium stearate/oleate may be reduced, but not lower than 18 grams.

C. Preparation of Soap Scum Suspension
1. Preparation of 14.65% Nonvolatile Soap Scum Suspension:
(a) Prepare a solution of 0.038% wt./wt solution of Sudan IV dye in propylene glycol as follows:
1. Add 0.19 g. of Sudan IV to 500 g propylene glycol,
2. Homogenize for 5 minutes. (PowerGen 700 setting of 2),
3. Filter using Whatman 41 filter paper (or equivalent).
(b) Add, with hand stirring using a spatula,
1. 30 g. of powdered 1:1 calcium stearate/oleate,
2. to 175 g of filtered 0.038% Sudan IV dye solution in propylene glycol,
3. Continue hand stirring until the powder is blended into the Sudan solution.
4. Homogenize the solution for 10 minutes. (PowerGen 700 setting of 2),
5. Mixture will be warm and thin. Leave mixture in place for approximately 1 hour to allow to setup and cool,
6. Transfer to jar—however, do not cover until completely cooled.

D. Preparation of Tiles
1. Clean the porcelain enameled metal tiles with scrubbing Bubbles (or equivalent soap scum remover-Tilex Soap Scum Remover) and warm tap water.
2. Scrub surface tile with ZUD cleanser and rinse with deionized water.
3. Clean a second time with Alconox® (Micro® or equivalent) cleaner.
4. Rinse with deionized water.
5. Prior to coating soap scum, wipe each tile with a cheesecloth pad soaked with acetone. Heat each tile at 180° C. for 5 minutes in a conveyor oven. If a conveyor oven is not available, bake racked tiles at 180° C. for 5 minutes in a forced draft or convection oven.
6. Allow tiles to cool in a constant 22° C.±2° C. temperature environment at least one hour, but no longer that 24 hours before applying soap scum.
7. It is advisable to cover the rack of tiles to avoid accumulation of dust.

E. Application of Soap Scum to Tiles
1. Tiles used for application of soap scum must have been cleaned/heated according to step C of this procedure.
2. Tiles must have been acetone wiped and heated no less that 1 hour and no longer than 24 hours prior to application of soap scum.
3. Weigh a tile, to 4 decimal places on an analytical balance, and record the weight.
4. Place the tile in the silk-screen tile holder place a 10xx silk screen, over the tile and apply a coating of soap scum suspension) preparation described in part B of this procedure) with the applicator.

5. Weigh the tile to determine if the amount of wet coating is within the range to yield a final coating weight range specified for the conditions of the test. If the wet coating weight is outside these specifications, re-apply the coating.
6. Heat the soiled tiles in a conveyor oven at 80° C. for 10 minutes or store in an open rack (preferably in a constant temperature environmental chamber) at room temperature (approximately 22° C.) at least 12 hours, but not more than 24 hours, in order to allow the propylene glycol to slowly evaporate.
7. Next, heat (bake) the tiles in a conveyor oven at 180° C. for 2 minutes.
8. Allow the tiles to cool in a constant 22° C.±2° C. temperature environment at least one hour before testing.
9. Weigh each tile before testing and record the weight.

F. Cleaning Efficacy Testing

1. Testing Procedure—"Strokes to Clean" Procedure

After placing the tile(s) in the sample holder, begin scrubbing by switching the machine to "on". Do not set the scrubbing machine to stop after a specific predetermined number of cycles. Observe the tile(s) during the scrubbing cycles until all of the soil is removed (determined by visual observation). A cycle is defined as a pass of the sponge across the tile in two directions (one direction and back in the opposite direction) with the sponge returning to its original position. Record the number of cycles required to complete soil removal as "strokes to clean" (STC). When two products are tested simultaneously, allow the scrubbing cycles to continue until soil removal is complete for each product and record STC for each product. Record "40+" STC when soil removal is incomplete after 40 cycles.

2. Gravimetric Procedure

After placing the tile(s) in the sample holder, set the scrubbing machine to a predetermined number of cycles. A cycle is defined as a pass of the sponge across the tile in two directions (one direction and back in the opposite direction) with the sponge returning to its original position. Begin the test by switching the machine to "on". After scrubbing, remove the tile(s) from the sample holder and gently rinse with deionized water such that only test product and already loosened soil are rinsed from the tile. Allow the tiles to dry in a constant 22° C.±2° C. temperature environment for at least 8 hours. Weigh the dried tiles on an analytical balance. Record the final weights. Calculate the percent soil removed as follows:

$$\%\ \text{Soil Removed} = \frac{\text{Soiled Tile Weight} - \text{Final Tile Weight}}{\text{Soil Tile Weight} - \text{Initial Tile Weight}} \times 100$$

Spray the product to be tested on to the soiled area of the tile and note how many sprays it takes to cover that soiled area (with the trigger product). Use that number of sprays in the test so that the coverage of the tile and soiled area is complete. Weigh the spray before and after spraying to record the amount of product dispensed. After spraying the tile wait for some predetermined amount of time interval(s) to allow the product to dwell on the tile surface. If wiping is required, place the tile on a Gardner Scrub machine and wipe the surface a predetermined number of times with a damp sponge. Gently rinse the tile with deionized water such that only test product and already loosened soil are rinsed from the tile. Set the tile in the holding rack.

Record the following information:

Spray distance to the soiled tile from spray bottle (set at 8 inches if none is specified on the label use directions for the products).

Amount of product dispensed on to each tile (in grams).

Dwell time of product on soiled tile.

If wiping is required use 7 cycles (14 strokes with a damp sponge across the tile surface after placed on the Gardner Scrub machine.

Or

If wiping is not required, simply rinse tiles after dwell time is complete.

3. Gravimetric Procedure—

Allow the tiles to dry in a constant 22° C.±2° C. temperature environment for at least 8 hours. Weigh the dried tiles on an analytical balance. Record the final weights. Calculate the percent soil removed as follow:

$$\%\ \text{Soil Removed} = \frac{\text{Soiled Tile Weight} - \text{Final Tile Weight}}{\text{Soil Tile Weight} - \text{Initial Tile Weight}} \times 100$$

4. Clean Up.

Repeat the testing procedure until all products of interest are tested at least ten times.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A concentrated liquid cleaning composition comprising (a) a linear alkyl benzene sulfonic acid;

(b) an alkyl ethoxylated nonionic surfactant having a carbon chain with 6-15 carbons and 5-10 ethylene oxide units;

(c) at least one iso- or non-linear C1-C6 alkanol amine or alkyl amine;

(d) fragrance; and (e) water and/or water-soluble solvent;

wherein components (a) and (b) are present in relation to said concentrated liquid cleaning composition based on 100 wt. % in a ratio of (a) to (b) of 0.5:1 to 4:1, wherein (a) and (c) react with each other such that a sulfonic group of (a) is added to (c); and wherein said composition excludes monoethanolamine, diethanolamine and triethanolamine from inclusion therein.

2. A concentrated liquid cleaning composition comprising (a) about 3 to about 50 wt. % linear alkyl benzene sulfonic acid;

(b) about 4 to about 76 wt. % alkyl ethoxylated nonionic surfactant having a carbon chain with 6-15 carbons and 5-10 ethylene oxide units;

(c) about 0.7 to about 12 wt. % of at least one iso- or non-linear C1-C6 alkanol amine or alkyl amine;

(d) about 0.1 to about 15 wt. % of fragrance; and (e) water and/or a water-soluble solvent;

wherein components (a) and (b) are present in relation to said concentrated liquid cleaning composition based on 100 wt. % in a ratio of (a) to (b) of 0.5:1 to 4:1; wherein (a) and (c) react with each other such that a sulfonic group of (a) is added to (c); and wherein said composition excludes monoethanolamine, diethanolamine and triethanolamine from inclusion therein.

3. The concentrated liquid cleaning composition of claim 1, wherein said composition is contained in a water-dissolvable plastic pouch.

4. The concentrated liquid cleaning composition of claim 2, wherein said composition is contained in a water-dissolvable plastic pouch.

5. The concentrated liquid cleaning composition of claim 1 further comprising a nonaqueous solvent.

6. The concentrated liquid cleaning composition of claim 2 further comprising about 10 to about 90 wt. % of an nonaqueous solvent.

7. The concentrated liquid cleaning composition of claim 1, wherein component (a) is dodecyl benzene sulfonic acid and component (c) is isopropanolamine or isopropyl amine.

8. The concentrated liquid cleaning composition of claim 2, wherein component (a) is dodecyl benzene sulfonic acid and component (c) is isopropanolamine or isopropyl amine.

9. The concentrated liquid cleaning composition of claim 7 further comprising hexylene glycol or hexylene glycol ether.

10. The concentrated liquid cleaning composition of claim 8 further comprising hexylene glycol or hexylene glycol ether.

11. The concentrated liquid cleaning composition of claim 3, wherein said plastic pouch is made of polyvinylalcohol.

12. The concentrated liquid cleaning composition of claim 4, wherein said plastic pouch is made of polyvinylalcohol.

13. The concentrated liquid cleaning composition of claim 1, wherein (a) is dodecyl benzene sulfonic acid.

14. The concentrated liquid cleaning composition of claim 2, wherein (a) is dodecyl benzene sulfonic acid.

15. The concentrated liquid cleaning composition of claim 1, wherein the ratio of (a) to (b) is 1:1 to 4:1.

16. The concentrated liquid cleaning composition of claim 2, wherein the ratio of (a) to (b) is 1:1 to 4:1.

17. The concentrated liquid cleaning composition of claim 9, wherein said ratio of (a) to (c) is 1:4.

18. The concentrated liquid cleaning composition of claim 10, wherein said ratio of (a) to (c) is 1:4.

19. A concentrated liquid cleaning composition comprising (a) dodecyl benzene sulfonic acid, (b) a primary ethoxylated alcohol with 6-15 carbon atoms and 5-10 ethylene oxide units, (c) isopropanolamine or isopropyl amine, (d) hexylene glycol or hexylene glycol ether, (e) fragrance, and (f) about 0.1 to about 9 wt. % water; wherein (a) and (b) are present in said concentrated composition in a ratio of (a) to (b) of 0.5:1 to 4:1; wherein (a) and (c) react with each other so that a sulfonic group of (a) is added to (c); and wherein said composition excludes monoethanolamine, diethanolamine and triethanolamine from inclusion therein.

20. The composition of claim 1, wherein said composition has a pH of about 2 to about 8.5.

21. The composition of claim 2, wherein said composition has a pH of about 2 to about 8.5.

22. The composition of claim 19, wherein said composition has a pH of about 2 to about 8.5.

23. The composition of claim 1, wherein said composition has an acidic pH and antimicrobial properties in absence of inclusion of an antimicrobial compound in said composition.

24. The composition of claim 2, wherein said composition has an acidic pH and antimicrobial properties in absence of inclusion of an antimicrobial compound in said composition.

25. The composition of claim 19, wherein said composition has an acidic pH and antimicrobial properties in absence of inclusion of an antimicrobial compound in said composition.

* * * * *